219-121
9/14/76 XR 3,980,802

United States Patent [19]
Paton et al.
[11] 3,980,802
[45] Sept. 14, 1976

[54] METHOD OF ARC CONTROL IN PLASMA ARC FURNACE TORCHES

[76] Inventors: Boris Evgenievich Paton, Apt. 21, 11/13, Kotsubinskogo Str.; Victor Iosifovich Lakomsky, Bastionoja, ul. 10; Gary Alexandrovich Melnik, ul. Prazhskaya 3, kv. 169; Anatoli Ivanovich Chvertko, Blvd. Lesiga, Ukrainka 2; Alfred Iosifovich Bukalo, Apt. 69, 8/2, Zaporozhtsa Str., all of Kiev, U.S.S.R.

[22] Filed: Aug. 20, 1974

[21] Appl. No.: 498,937

Related U.S. Application Data

[62] Division of Ser. No. 409,329, Oct. 24, 1973, Pat. No. 3,849,584.

[52] U.S. Cl. ..... 13/18; 219/121 P
[51] Int. Cl.[2] ..... H05H 1/26
[58] Field of Search..... 13/9, 9 P; 219/121 P, 219/75

[56] References Cited
UNITED STATES PATENTS 2,951,143 8/1960 Anderson et al. ..... 219/121 P
3,790,742 2/1974 Auer..... 219/121 P

*Primary Examiner*—R. N. Envall, Jr.
*Attorney, Agent, or Firm*—Strauch, Nolan, Neale, Nies & Kurz

[57] ABSTRACT

A plasma arc remelting furnace system with improved components including mechanisms for independently vertically feeding and oscillating the metal blank through the top of the furnace. Multiple plasma arc torches (plasmatrons) are installed in a sealed chamber and adjustable operators enable angular disposition of individual torches. The torches have improved torch nozzles with heat sink construction enabling operation at higher temperatures, better stablized plasma arcs and longer torch life. The system can utilize ingot molds of various cross section shapes, i.e., round, square, rectangular and polygonal and, depending upon mold shape, the number of torches can differ. Operating circuits are provided for use with a plurality of different numbers (up to eight) of torches, either with direct current or alternating current power sources, and possible variations of circuits will enable using a larger number of torches.

9 Claims, 20 Drawing Figures

3 UNITS
6 UNITS
4 UNITS
8 UNITS
KA
BI
54'
54"
360
362
380

FIG. 20

| MATERIAL DESIGNATION | HEAT CONDUCTIVITY COEFFICIENT $\lambda, \frac{cal}{cm.\ sec.\ deg}$ | MELTING TEMPERATURE OF THE MATERIAL Tm, °C |
|---|---|---|
| GRAPHITE | 0.12 – 1.0 | 3407 Tm, °C |
| TUNGSTEN | 0.38 – 0.47 | 3200 |
| RHENIUM | 0.38 – 0.47 | 3150 |
| COPPER | 0.92 | 1083 |
| MOLYBDENUM | 0.364 | 2600 |
| TANTALUM | 0.195 | 3027 |
| ZIRCONIUM | 0.2 | 1860 |
| ZIRCONIUM NITRIDE | 0.08 | 2980 |
| NICKEL | 0.14 | 1452 |
| IRON | 0.12 | 1530 |
| HAFNIUM | 0.07 | 2200 |
| ZIRCONIUM OXIDE | 0.05 | 2760 |

METHOD OF ARC CONTROL IN PLASMA ARC FURNACE TORCHES

CROSS-REFERENCE TO RELATED APPLICATION

This application is a division of application Ser. No. 409,329, filed Oct. 24, 1973 (now U.S. Pat. No. 3,849,584).

BACKGROUND OF THE INVENTION

The present invention was developed to provide improved operation and longer life for plasma arc remelting systems used to make metal ingots and components of such systems. Together with the improved structure the invention contemplates improvements in the methods for the operation of such systems.

Installations in the prior art used for the production of ingots in plasma arc remelting teach use of a cooled mold with a vertically movable bottom part for lowering the ingot being made. The mold is positioned within the lower portion of a hermetically sealed chamber and the installations utilize one or several plasma torches connected to a source of electrical energy. A suitable power operated mechanism connected to the bottom part provides for moving that part and extracting the formed ingot. Reference can be made to U.S. Pat. Nos. 3,147,329 and 3,496,280 for explanations of plasmatron operation and plasma arc remelting.

One known installation of this type is disclosed in British Patent 1,237,155 based, in part, on prior development work of several of the applicants hereof. A serious problem encountered was that the plasma arcs frequently burned through the water cooled torches and/or the mold, thereby releasing the coolant fluid into the evacuated space of the chamber and causing serious explosions due to the presence of high temperature molten metal therein. In that installation plasma torches having a fixed position with respect to the mold were provided for melting a metal blank which was lowered into the remelting chamber. Difficulties with the thermal balance in this installation were encountered and overcome. Another problem was that the plasma arcs did not occupy the same paths between the plasma torches and the mold in successive runs. As a result the metal blank was not uniformly melted in this apparatus.

Many of these disadvantages were overcome by development of the improved system disclosed in part in a U.S.S.R. publication entitled Stahl, No. 6, 1971 which teaches top feeding and revolving of a blank in a plasmatron furnace as well as angular adjustment of at least one of several torches arranged to direct the plasma arc flame downwardly toward the lower end of the blank and against the upper end of the water-cooled mold. Those improvements enabled operation wherein at least one of the plasma arc torches is adjustably mounted via a ball and socket joint in the chamber so that the position of its plasma arc flame can be adjusted with respect to the mold and wherein the metal blank being melted can be rotated as well as lowered axially into the remelting zone within the chamber.

Radial arrangement of several plasmatrons around a crystallizer allows the placement of heat sources evenly around the molten pool, or bath, of metal which exists at the top of the ingot being formed. Precise regulation of the heating of all sections of the bath is obtained by changing the circumferential distances between the plasmatrons. It is known, that at low remelting rates, 70 to 80% of the heat released by the solidificating ingot is removed to the water-cooled copper crystallizer through its contact strip with the bath. In heating the bath by plasma flames placed along the periphery of the bath it is easy to obtain its flat shape. Also, at a certain inclination of the plasmatrons to the bath, one can make the liquid metal revolve, at a desired rate, around the vertical axis by using the energy of plasma jets.

The experience in operation of plasma-arc furnaces with a radial arrangement of plasmatrons around the crystallizer has shown, that through control of the heating of the bath by changing the peripheral distances between the plasmatrons, one can obtain in the same furnace (by changing only the crystallizer and priming) round, square, rectangular and other shaped ingots from the same blank, for instance, of round cross section.

Another significant advantage of the multi-plasmatron furnace with axial feed of the blank is an essential (almost 70%) radiation screening of the plasma jets and bath by the blank. Blanks larger than 150 mm in diameter are melted close to free surface of the bath and their melted face takes a falt or a concave form, thus causing an increase in the efficiency of the remelting process. In this case the demands put on the quality of the blanks are less rigid than on blanks used in furnaces with sidewise feed of blanks, where usually the blanks must be much thinner than the ingot and therefore their manufacture consumes more labor. Blanks for multi-plasmatron furnaces can be of round or square cross section, or they can be composed of end and side scrap of sheet. In the case of remelting a loose material in a furnace with a radial arrangement of plasmatrons, the material is fed to the middle of the bath, securing a good and complete melting of the fed material.

A non-uniform temperature field is generated during melting of a metal in a water-cooled copper crucible by intensive heat-energy flow from plasmatrons. Temperature gradients can reach 200°/cm. The non-uniform temperature field generates free-convexion macro-flows, causing a stirring of the metallic bath with an intensity directly proportional to the number of plasmatrons installed in the furnace. This stirring promotes a chemical homogenization of the molten metal and accelerates the reactions which take place in the diffusion zone. Therefore, in the multi-plasmatron furnaces ingots of higher quality can be obtained than in single-plasmatron furnaces, not only because of the thermal conditions of the process, but also in connection with a more favorable diffusion kinetics of metal-refining reactions.

Experience gained from those previously known plasma arc remelting systems brought to light various difficulties in obtaining appropriate control over torch adjustment, operational functioning of the feed and revolving structures and emphasized the very short torch life, one of the major problems of plasma arc torches used in furnace systems for remelting metals.

The location of plasmatrons around the crystallizer of the furnace does ensure better operational conditions than in the case of axial arrangement, where the whole, or almost the whole, capacity of the furnace is concentrated in a single plasmatron. Nevertheless, to be economically feasible and acceptable, the plasmatrons used in metallurgy, whether in single or multi-torch furnaces, unlike plasma generators for welding, cutting, surfacing, etc., must possess a considerable resource in working capacity and be reliable in operation; in this respect the ablation of the tungsten cathode and the failure of the nozzle must be eliminated or reduced to a minimum. The stronger is the current of the power source, the more difficult it is to secure high working capacity of the plasmatron. Prior art plasma arc torches have been water cooled, the nozzles have been water cooled and even the center electrode has been water cooled but still the tunsten cathodes and the nozzle structures fail in a short time, often before an ingot is completed.

SUMMARY OF THE INVENTION

Primary objects of the invention reside in a method of generating a high temperature plasma arc torch path and preventing destruction thereof over a long period of operational life which may be accomplished by using one or more of the following plastmatron nozzle constructional details: smooth gas flow path profile to avoid turbulence as well as shock formations at supersonic flow; torch electrode projection (preferably 2–3 mm) from nozzle body; use of heat sink inserts within the nozzle orifice and surrounding the electrode; press-fit heat seat inserts enabling ease of replacement; projection of heat sink inserts (preferably 10–15 mm) from the terminal end of the nozzle; torch electrode and heat sink inserts both projecting from the nozzle terminal end with inserts projecting beyond the electrode; nozzle being fluid cooled but with no cooling at the terminal end; nozzle made from copper with high heat conductivity and including heat sink inserts of other material having not only a high degree of heat conductivity but also a high melting temperature; cylindrical inserts having chamfered ends; torch electrode spaced from heat sink inserts at a preferred distance of 2–7 mm, electrode diameter being at least 8 mm, and nozzle orifice having a diameter preferably within the range of 10–30 mm; and, heat sink inserts peferably being made of tungsten or other material having similar melting point and thermal conductivity properties. Each of these aspects contributes to increased torch life.

A further object results in a method of generating a high temperature plasma arc torch path operable over an extremely long life by controlling the detrimental intermediate arcing between a plasmatron electrode and nozzle to avoid nozzle destruction by reducing the flow factors which occasion intermediate arcing, shielding the nozzle tip components with low melting temperatures from the detrimental effects of intermediate arcing and deliberately causing a shift of the intermediate arcing from a zone wholly offset within the nozzle terminal edge to a zone closer to and even offset beyond the nozzle terminal edge.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings, in which:

FIG. 20 is a table showing the heat conductivity coefficient and melting temperatures for several materials considered for making heat sink inserts.

GENERAL DESCRIPTION

Figures 1, 2, 3, 4, 5:
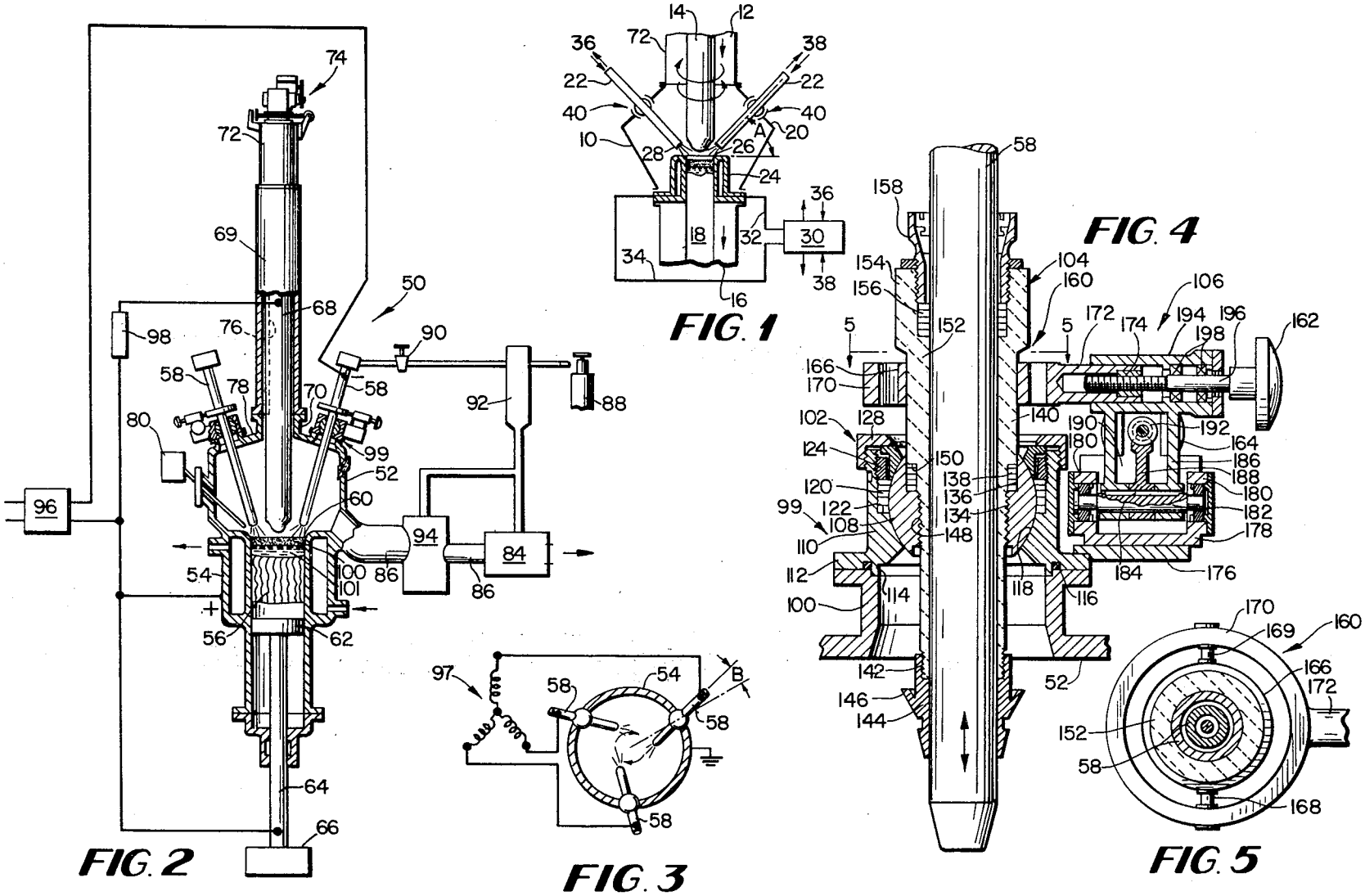
FIG. 1 is a schematic elevation section view of the major components of a plasma arc remelting furnace and system to which the present invention applies.
FIG. 2 is a front elevation diagrammatic sketch of a plasma arc remelting system.
FIG. 3 is a plan schematic view of the positioning of the plasma arc torches in the installation of FIG. 2 and includes a schematic 3 phase AC power circuit.
FIG. 4 is an enlarged vertical cross-section view of the ball and socket connection providing projection of each torch into the furnace chamber, and shows details of the correlated torch angle positioning control members, the plasma arc torch not being sectioned.
FIG. 5 is a section view taken on line 5—5 of FIG. 4 showing the sliding collar and gimbal connection between the operating mechanism and the torch mounting sleeve.

With reference to FIG. 1, a brief general description of the plasma arc remelting installation to which the invention pertains is shown with a hermetically sealable chamber 10 having an opening 12 at the top portion thereof for accommodating a vertically positioned metal blank 14 and an opening 16 in the lower portion thereof for accommodating a solidified ingot 18. The chamber includes an outwardly downwardly inclined roof portion 20 which supports a plurality of plasma torch devices 22 which extend through the chamber roof into the vicinity of the lower end portion of the metal blank 14. A hollow wall fluid cooled mold 24 is positioned into the lower end of the chamber with its upper mouth 26 spaced closely adjacent the nozzle ends 28 of the plasma arc torches 22. A coolant system 30 is provided for supplying cooling fluid through collant lines 32 and 34 to the mold 24 and also for providing cooling fluid for plasma arc torches 22 through dual lines 36 and 38. The walls of the chamber 10 may also be made hollow and the cooling system 30 may also be connected with the chamber 10 to provide cooling in its sidewalls thereof.

In general, the operation of a plasma arc remelting installation such as depicted in FIG. 1 is as follows. Plasma arc torches 22 are connected with a conventional source of electrical power AC or DC (not shown) which is also connected directly to the ingot 18 and mold 24. A metal blank 14 to be melted is suspended from the top of chamber 12 to a location within the upper portion of the chamber 12 in substantially the position shown in FIG. 1. The chamber is sealed and all air within the chamber is exhausted to a vacuum in the order of $10^{-2}$ mm. Hg and the chamber is scavaged with an inert gas such as argon. The plasma arc torches are then sequentially ignited by the use of a direct current pulse between the torch body, e.g. nozzle, and the cathode from the power supply source. A convenient method establishing ignition or initiating DC pulse is to employ a common oscillator connected between the cathode and torch body of the torch means to be started and the mold 24. Once the plurality of torch means have been started the metal in blank 14 is progressively melted and drops into the mold 24, forming a molten metal bath on top of ingot 18. Metal blank 14 is progressively lowered as it is melted off and ingot 18 is progressively extracted from the bottom portion of chamber 16 as the molten metal pool progressively solidifies by reason of the heat extracted by the fluid cooled mold 24. Metal blank 14 is axially lowered into the remelting zone defined by the plasma arcs issuing from the plasma arc torches 22. It can also be oscillated or rotated as shown by the rotation arrow while being lowered into the remelting zone. By carefully controlling the remelting parameters and adjusting the positions of the plasma arc torches 22 with respect to the melting end of metal blank 14, the liquid level of the molten metal pool in the top of mold 24 can be maintained at a constant position within the mold to attain balanced thermodynamic conditions within the remelting zone and the molten metal bath and to produce a high quality metal ingot which is substantially free from nonmetallic inclusions, stringers, and gas bubbles. The grain pattern shown by the ingots thus produced is of the ideal herringbone formation wherein the grain patterns are directed from the center of the ingot upwardly and outwardly toward the exterior surfaces thereof.

The axial moving of metal blank 14 and the rotation thereof can be selectively used when needed, and particularly rotation of the ingot need not be used in all cases since the plasma arc torches are adjustably mounted within chamber 10.

In the schematic diagram of FIG. 1, the plasma arc torches are positioned within chamber 10 in such a manner that their longitudinal axes define an angle A with a plane defined by the horizontal top of mold 24. This angle can be varied by virtue of the adjustable feature of the plasma arc torches by reason of ball joints 40 and operating mechanisms (FIGS. 2, 3 and 4) which are secured in and to the roof portion 20 of the plasma arc remelting installation. The position of the ball joints with respect to the plasma arc torches 22 define a fixed point along the axis about which variable angular positioning of the torch is possible. It is also possible to adjust the longitudinal axial position of the torches 22, which is usually fixed for a specific furnace system, by moving them inwardly and outwardly along their axis in order to bring the plasma arc torches closer to and further away from the mouth portion 26 of mold 24. This adjustable feature of the plasma arc torches allows an existing plasma arc installation as described herein to produce a variety of cross sections of ingots 18 by inserting different molds 24 into the plasma arc chamber 10. For example, a circular cross section mold can be removed and replaced with a square or rectangular cross section mold whereupon the plasma torches will be adjusted as needed to accommodate the different size and shaped molds and hence the ingots being made. As shown the mold 24 is removable retained within the body of chamber 20. The top portion, the chamber, the mold and the lower portion are secured by interconnected flanges enabling separability of the furnace components.

The schematic diagram of FIG. 2 shows a plasma arc installation 50 equipped with operational supporting subsystems therefor. Although not depicted, the furnace components can be separable as described for FIG. 1. The hermetically sealable chamber 52 is provided with a fluid cooled mold 54 which is shown integrally constructed with respect to the remaining portions of chamber 52 and is arranged to form an ingot 56. A plurality of plasma arc torches 58 are positioned so as to direct the plasma arcs toward the upper mouth portion 60 of mold 54. The plasma arc torches are adjustably mounted and in the position shown have their axes in vertical planes which are directed at acute angles to the vertical axis of the mold 2. These adjustable torches can either extend in a vertical diametric plane of the mold or their yaw angle can be adjusted so the plasma arc has a direction with a component extending tangentially which will rotate the bath of molten metal in the mold 54. An arrangement of the torches 58 having a tangential component is diagrammatically illustrated in FIG. 3.

The mold 54 has a movable bottom or carriage 62 which is connected via rod 64 to an ingot extracting mechanism 66.

Metal blank 68 is supported to project down through the upper sleeve extension 69 on neck portion 70 in the roof of chamber 52 by a flanged end bell housing 72 and blank feeding and oscillating mechanism 74. The power driven mechanism 74 operates to feed and to rotate or oscillate the blank during remelting. A side hatch 76 can be provided in sleeve extension 69 and/or upper neck portion 70 in order to provide for insertion of the metal blank 68 and for withdrawing of the spent stub of the blank following the melting operation, however the entire bell housing 72 and the operating mechanism can be disconnected and lifted as a unit from the chamber 52 to insert the blanks and to withdraw the spent stub.

Plasma arc torches 58 are positioned within the upper roof portion 78 of chamber 52 and are adjustably mounted therein in the manner as will be hereinafter described relative to FIG. 4. In order to melt a metal charge in installation 50 it is not necessary to employ a solid metal blank 68. It is also possible to add the charge by feeding metal particles, such as scrap, into the upper mold mouth 60 from a hopper 80 connected with the interior of the chamber through a feed trough 82.

Other parts of the support system include a vacuum pump 84 connected through a pipe line 86 with the crystallizer chamber 52 which, along with plasma arc torches 58, is supplied with plasma forming gas or gas mixtures from a gas supply tank 88 which is connected to each plasma arc torch through a gas distribution device 90 (one shown) designed to simultaneously control the gas consumption as well as the ratio of gases in the plasma gas mixture.

To assure constant pressure in the crystallizer chamber 52 during the melting cycle, provision is made for a gas recirculating circuit comprising a diaphragm compressor 92 connected to the distribution device 90 and through a system of gas filters 94, which include a chemical purification system containing absorber devices, to pipe lines 86.

The plasma arc remelting installation can be supplied with either a DC or AC power supply from an electrical power source through a control unit 96. In a conventional manner, the cathodes of the plasma arc torches 58, in a DC mode, are connected to the negative terminal of the supply source 96 while the mold 54 is connected to the positive terminal. In such case the positive terminal of the DC source may connect directly to the mold or to the ingot through the ingot withdrawing mechanism 66 or to both the mold and the mechanism 66.

The electrical power source portion of unit 96 can be a 3-phase alternating transformer having its secondary windings arranged in star form 97 (FIG. 3) with each leg connected to a respective plasma arc torch 58 and with the star neutral point or center connector insulated from ground and from the mold 54. In this AC circuit connection the mold 54 can be and in the normal installation is usually grounded.

Briefly stated, to start a plasma arc remelting operation, the metal blank 68 is inserted into the upper neck portion 70. Air in chamber 52 is pumped out by vacuum pump 84 until a satisfactory low pressure is reached such as $10^{-2}$ mm Hg. Chamber 52 is then filled and scavaged with a neutral gas which is then recirculated with the gas recirculation equipment 90, 82 and 94. Plasma arc torches 58 are then initiated in a manner described above and the positions thereof are adjusted in order to accommodate the particular type of cross-section of the ingot 56 being solidified within installation 50. When a molten metal bath is obtained in the upper part of mold 54 as the result of melting of the lower end portion of metal blank 68, the metal blank feeding mechanism 72 and the ingot extracting mechanism 66 are initiated.

Removal of nonmetal and gaseous admixtures in the molten metal bath, as well as the change of shape of the end of the metal blank 68 as a result of the fusion action and control over the drip forming process on the lower end of the metal blank can be conveniently varied within the installation 50 by adjustment of the axial positions thereof as above described without the necessity of replacing and rebuilding the entire installation 50 for each new position of the torches which is desired.

When the plasma torches 58 are positioned with a tangential component as described above with reference to FIG. 3, the molten metal bath under the action of the plasma arcs will rotate and speed of rotation can be regulated by varying the angle B (see FIG. 3) which the plasma torches form with the radial planes passing through the axis of the mold 54. Also, the force of the plasma arcs and intensity of heat radiation can be additionally controlled by varying the volume of the inert gas being pumped through the torches and also by varying the current applied to the torches.

The forming of molten metal drops on the lowermost end of metal blank 66 can be additionally regulated by varying the current being supplied by electric power supply means 96 by employing modulated pulses of current having an optimal pulse shape and duration. Pulsing of the gas being delivered from the torches can also be employed.

If during the melting process a molten slag cover 100 for the molten metal bath is required for refining of the metal, slag can be added through the trough of hopper 80 as desired during the process.

The cooled mold 54 is designed to extract up to 80% of the heat released by the solidifying ingot through the cooling system therefor.

The molten metal pool 101 supported by the solidified ingot 56 forms a flat shallow bath in the installation 50 which has a maximum depth dimension to maximum cross-sectional dimension (diameter for FIG. 3) of the mold of from 1/5 to 1/10. Within this molten metal bath the temperature gradient can be up to about 200°C per centimeter by employing currents of from 500 to 5000 amps. and voltages of from 40 to 200 volts. The operation power level of the installation 50 is from 150 to 3000 kilowatts in order to produce ingots having weight varying from 50kg. to 5000 kg.

TORCH ADJUSTMENT

The manner in which the plastrons are adjustably mounted in the walls of the crystallizer will now be described with general reference to FIG. 2 and reference to FIGS. 4 and 5 for details. Each torch 58 is an elongate, essentially tubular member, normally made from a material such as copper which has extremely good heat conductivity. The main torch body 58, not herein described in detail, is made with hollow walls (FIG. 4) and has provision for circulating a fluid cooling medium such as water, from an inlet at the exterior of chamber 52 down through the torch body to and around the nozzle end and then back up through the body to an outlet, as has been described in connection with FIG. 1. Some torches also have the central electrode holder cooled by cooling fluid. Surrounding the electrode is an annular passage for introduction of inert plasma gas such as argon.

In accord with the present invention, the roof portion 78 of crystallizer chamber 52 includes a plurality of flanged apertures 100 accommodating the sealed mounting of a desired number of torches 58 through associated adjustment assemblies 99. Each torch 58 projects through its own adjusting assembly 99 into the crystallizer and each assembly 99 has a ball and socket unit 102, a torch to ball sleeve gland arrangement 104 and a torch swivelling adjustment mechanism 106.

Torch 58 projects down into the crystallizer chamber 52 through a seal in the sleeve gland arrangement 104 which passes through and is secured and sealed to the ball 108, which is secured and sealed in its socket.

The socket of the ball and socket arrangement 102 consists of several parts including a base 110 having a flange 112 by which the base is secured by suitable bolts to an associated upstanding flanged aperture 100 in the crystallizer cover. The connection between the socket base flange and the aperture flange is sealed by a spigotted construction 114 and a heat resistant seal ring 116. Ball 108 seats in partial spherical seat 118 machined in the socket base 110 and multiple contoured ring seals 120, placed in an annular recess 122 in the base and secured by a ring nut clamp 124 socket base, provide a friction tight fluid seal between the socket base and the surface of ball 108. A ring-shaped, partially spherical ball cap 126 is disposed to extend down within the seal ring unit 124 and fit against the ball 108, being held in its position by a threaded, seat cap clamping ring 128 screw threaded over the socket base 110. Clamping ring 128 is tightened an amounnt sufficient to provide a proper seating relationship yet still enable the desired swivelling fit between the ball 108 and seat surfaces. Ring nut 124 is used to tighten the seals 120 to provide a gas tight seal between the ball and the socket.

Ball 108 is apertured with a through bore, partially threaded at 134 below an enlarged annular recess 136 within which is received a group of heat resistant seal rings 138. A sleeve 140, having a close sliding fit over the cylindrical body of torch 58, is part of the sleeve gland assembly 104, and has several external stepped portions. The lowermost terminal portion 142 of the sleeve 140 projects into the crystallizer chamber 52 and is threaded. A heat shield ring 144, disposed with a sliding fit over the lower end of the torch, is threaded on the inner terminal end of sleeve 140 and in assembly is positioned just within the crystallizer chamber. Sleeve 140 is made from insulating material. Shield ring 144 is made of a heat resistant material, having a high melting point, and includes an inverted, frusto-conical skirt 146 which by deflecting and blocking the high temperature radiation from the plasma arc flames shields the sealed ball joint zone at the associated chamber aperture 100 from the intense heat.

A mesial threaded portion 148 of sleeve 140 screws into the internal threads 134 of the ball 108 so that a shoulder 150 abuts and compresses the seal rings 138 between the sleeve and the ball. A portion 152 of sleeve 140 external of the chamber is cylindrical and terminates in a threaded gland cup 154 which holds packing rings 156 compressed by a gland nut 158. By loosening nut 158, the torch 58 can be axially shifted through the gland sleeve so the torch nozzle end can be positioned the desired distance from either or both of the blank and the molten metal pool or slag bath at the upper part of the mold. When the desired axial disposition of the torch is obtained, the torch is rigidly secured to the sleeve by tightening gland nut 158, and the torch will normally be maintained in such position throughout the remelting operation.

With the construction shown in FIG. 4, torch 58, sleeve 140 and ball 108 can be swivelled 15° in any direction from a coaxial axis through the associated chamber aperture 100. The angular disposition of torch 58 can be selectively set via the adjustment mechanism 106 which connects to the torch assembly through a gimbal device 160 slidably embracing the heavy cylindrical outer portion 152 of gland sleeve 140.

The gimbal device is shiftable in two directions normal to each other, which for convenience can be designated as movements having components in X and Y axes, by adjustable control members 162 and 164, a part of mechanism 106. Gimbal device 160 has an inner ring 166 slipped over the heavy outer portion 152 of gland sleeve 140 with a free sliding fit. The ring 166 has diametrical trunnions 168 and 169 (FIG. 5) by which it is journalled to the outer gimbal ring 170 which in turn includes an integral projecting boss 172 through which adjustment control movements in both the X and Y axes are transmitted to the gimbal device. Gimbal boss 172 has an axial bore and includes, fixed within the bore, a threaded nut 174 for purposes which will presently be described.

Adjustment mechanism 106 is secured on a bracket 176 mounted as by screws or welding to the associated socket flange. A base member 178 secured to the bracket 176 has spaced bearing blocks 180 which journal a rock shaft 182 on an axis through the center of ball 108. Rock shaft has a keyed connection 182 to and carries both a rocking arm assembly 186 and a worm wheel sector 188. A back plate 190 integral with the base member 178 provides an axially fixed bearing connection for the shaft of a worm gear 192 meshed with the worm wheel sector 188. Both ends of the worm gear shaft will be journalled in rigid supports although only the back support plate 190 is shown. Control member 164 is a manual operating knob secured to the worm shaft so that rotation of the control member will rotate the worm and rock the rocking arm assembly 186 about an axis entending through the center of the ball 108.

The other control member 162 is carried at the upper end of the rocking arm assembly 186 in a sleeve-like construction 192 parallel to the rocking axis and into one end of which the elongate boss 172 of the gimbal device is telescoped. The control member knob 162 is fixed to one end of a threaded shaft 196 which is rotatably journalled in an axially fixed disposition within the sleeve construction 194 via bearings 198. The threaded end of shaft 196 is threaded into the nut 174 in the boss of the gimbal device 160, whereby rotation of control knob 162 will move the gimbal device 160 toward and away from the rocking lever along an axis parallel to the rocking axis, providing a swivel adjustment to the torch in one direction of the aforenoted X—Y adjustment. Rocking of the rocking arm 186, by means of control knob 164, rocks the gimbal device in the second direction of the X—Y adjustment.

Coordinated adjustment of the two control knobs 162 and 164 will enable selective positioning of the torch in any direction up to an angle of 15° so the plasma arc path can be directed, for example, along a diametral plane through the vertical axis of the blank to impinge closer to the blank or to an greater degree down into the molten metal bath and closer to the side walls. In conjunction with such adjustment the torch can be swivelled to provide a tangential component of the plasma arc path around the vertical axis of the mold to cause a swirl of the molten metal bath. Control members are manual knobs but power actuators, selected from many available types could, if desired, be substituted for the manually operated control knobs.

More accurate control of the positioning of the torches as well as ability to selectively control the torch angles during operation enables better and more even distribution of the melting temperatures relative to the blank and the molten pool at the upper end of the mold. This becomes extremely important as higher powered longer life torches are made possible as a result of the following advantageous improvements in the torch itself.

TORCH NOZZLE CONSTRUCTION

Operational experience has taught that the weak link in a PAR system is the torch nozzle. The electrode terminal end is disposed within the reduced diameter nozzle orifice. The torch start-up arc occurs between electrode and the nozzle surface while the running or operating arc occurs from the electrode to the melt or ingot being made. During operation an undesirable cross-arcing from electrode to nozzle occurs due to non-stable flow conditions. This undesirable cross-arcing, something which has been essentially impossible to avoid, is called intermittent arcing and causes ablation of the electrode and the nozzle and often results in burn-through at the nozzle aperture. The highest temperatures, i.e., the hottest plasma exists at the torch tip. The prior art torches including nozzle tip structure are water cooled and are conventionally made from copper. The prior art nozzle structures normally include hollow walls to provide the annular chamber for fluid cooling. Nozzle constructions, known prior to this invention, due to ablation and burn-through, had an extremely short operating life, not more than several hours and often not long enough to permit making a complete ingot.

Figure 6:
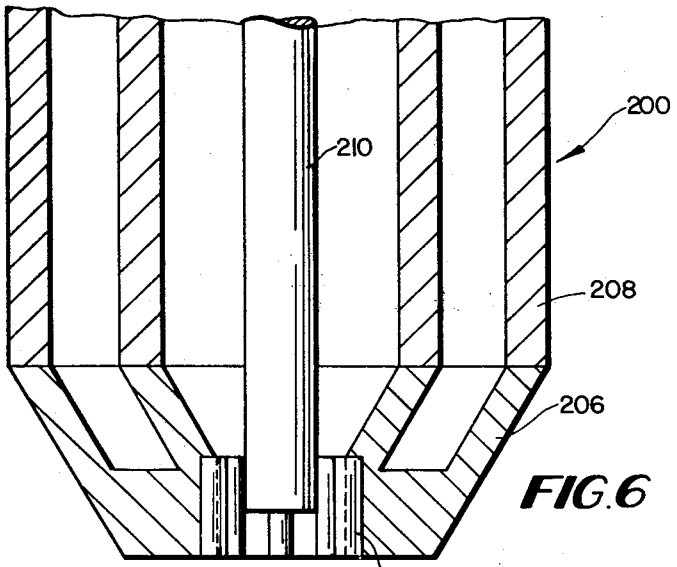
FIG. 6 is an enlarged vertical section through the nozzle end of a plasma arc torch showing an intermediate aspect in development of the embodiment illustrated in FIG. 8.
Figure 7:
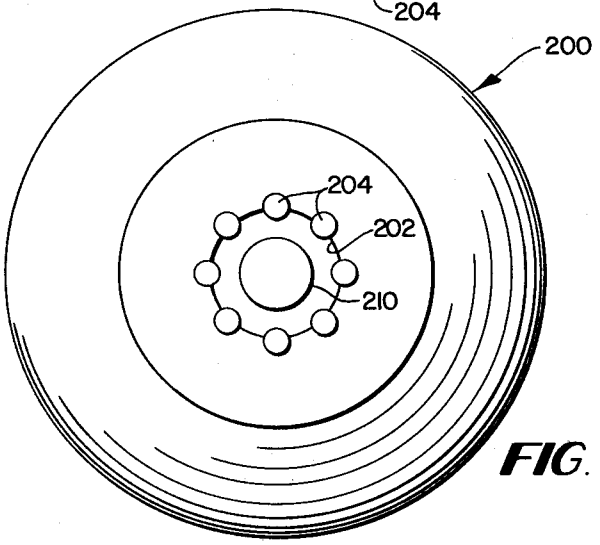
FIG. 7 is a bottom view of the nozzle shown in FIG. 6.

In accord with the present invention some conditions causing intermediate arcing are negated by providing a smoother gas flow pattern. Also by providing a heat sink structure at the nozzle, i.e., or controlling the location of the intermediate arcing by affording it a directed path from electrode to nozzle, the possibility of burn-through by the intermittent arcing is almost completely eliminated. To accomplish this desired function it was decided to shield the prior art hollow nozzle 200 tip with cylindrical metal inserts 204 as is shown in FIGS. 6 and 7 having good heat conductivity and high melting temperatures. Tungsten, being one material having a good heat conducting coefficient of 0.38 through 0.47 and a high melting temperature of 3200°C., was used in the form of small cylindrical rods 204 spaced around the inner periphery of the torch nozzle orifice 202. While a problem with tungsten is difficulty of machining, it has been determined that ground tungsten bars (cylindrical inserts) provide satisfactory heat sink inserts.

The first attempts at use of such inserts as shown in FIG. 6, were satisfactory to increase life at lower powers, however they did not provide much increased life at the desired higher powers due to thermal shock destruction of the brittle tungsten inserts, occurring because of intermittent arcing now being confined to the inserts. Proceeding from those attempts at using inserts, the nozzle of torch 218 has been further improved, in the manner shown in FIGS. 8 and 9, in several important respects, each of which contributes to the materially increased life of the nozzle tip and negates burn-off ablation or destruction of nozzle, electrode and heat sink insert material which, besides shortening the torch life, contaminated the ingot being made.

Figure 8:
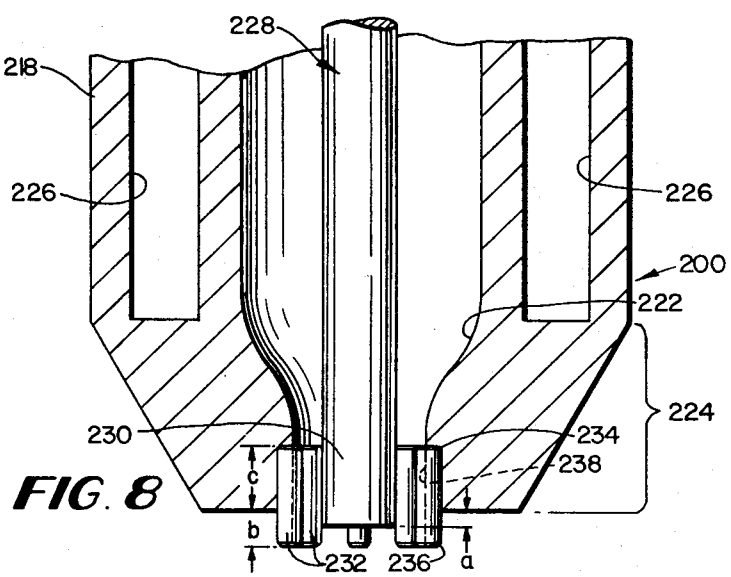
FIGS. 8 and 9 are views similar to FIGS. 6 and 7 but illustrating a plasma arc torch nozzle structure according to the present invention.
Figure 9:
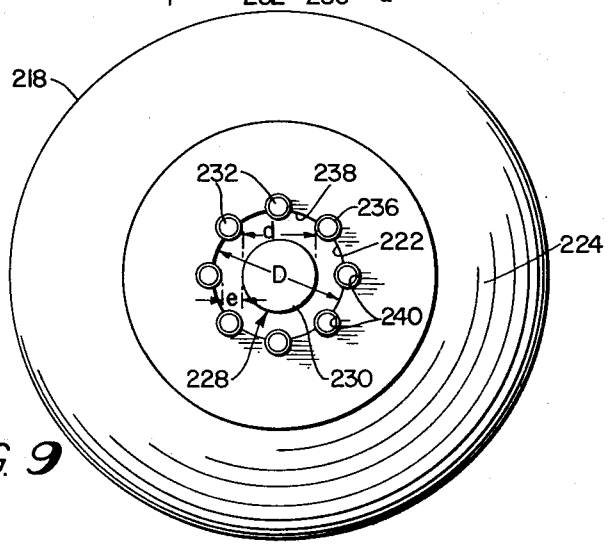

Referring specifically to FIGS. 8 and 9, orifice 222 of the nozzle 220 is constructed with a smoother profile curvature of the side wall configuration so flow of plasma gas adjacent the walls remains laminar rather than turbulent. Smooth nozzle curves can be calculated from known techniques but the advantages of acquiring and using such nozzle profiles in plasma arc torches has not been previously known, used, or appreciated. Laminar flow of the plasma forming gas is essentially necessary for stability of the plasma arc in higher powered torches which use a higher velocity gas flow and provide a long plasma flame. Note: non-laminar flow which has turbulent zones can be tolerated in low powered torches, i.e. those which produce short length plasma flame.

Nozzle exit diameter can vary from 10 mm to 30 mm. It has been found through experience that high power PAR torches should have a preferred nozzle exit diameter of 25 mm while lower powered torches have been found to perform satisfactorily using a 20 mm exit diameter.

Together with the changed nozzle orifice profile, the torch tip structure 224 (FIG. 8) is changed so that the annular cooling chamber as in the attached hollow tip 206 of FIG. 6 is omitted. In tip 224, the fluid passages 226 in the hollow torch walls do not extend down into the tip body around the reduced diameter nozzle 222 which surrounds the portion 230 of the terminal end portion of the electrode 228 which is disposed laterally adjacent the heat sink inserts 232. In other words, the nozzle tip 224 where the inserts are placed is solid metal (copper being preferred). Leaving out the water cooling at the nozzle tip avoids the intense thermal shock, resulting from inadvertent intermittent arcing from the electrode to the nozzle structure. In prior art nozzles, the intermittent arcing directly impinged on and resulted in rapid burn-through of the copper nozzles which were water cooled. Thermal shock of such arcing could be accommodated by the ductile property of the copper nozzles, however when tungsten inserts were added, the water cooled area maintained the tungsten at a temperature sufficiently cool so that the thermal shock of an intermittent arcing under the high powers resulted in fracturing the brittle tungsten inserts.

Together with the above structure it has been found that by projecting the electrode terminal tip 230 slightly below the terminal end of the nozzle tip per se, as shown by distance "*a*" in FIG. 8, laminar flow of the gas is enhanced, it will help maintain continuity and stability of the plasma arc flame path and it reduces wear of the electrode tip. An electrode projection distance "*a*" of from 2 to 3 mm below the torch tip plane has given highly satisfactory results at high powers. While the heat sink inserts 204 (FIG. 6) were mounted wholly within the nozzle tip, they were extended down past the tip end of electrode 210 which did increase useful life by shifting the location of the arcing as well as by shielding the nozzle tip from direct arcing action. The inserts 232 (FIG. 8) in accord with further aspects of the present invention are mounted slightly lower in the nozzle tip 224 and project from a transverse plane at the nozzle tip a distance "*b*" which is greater than the projection of the relocated electrode 228. Desired projection dimensions "*b*" of the inserts have been found to be from 10 to 15 mm. The resulting structural relationship between the solid nozzle tip, the smoothly curved laminar flow profile of the nozzle orifice, the relocated projecting electrode terminal end and the projecting heat sink inserts each are improvements which in and of themselves increase the useful life of the torch and when all of these improvements are used in combination the resulting plasmatron is capable of a very high powered operation with an extended length, stable plasma flame has been accommodated for over a 1000 hour life period before repair or replacement of component torch parts is necessary. It is believed that a very important aspects of this startling torch life improvement in high power operation is due to the essentially smooth walled profile 222 of the nozzle orifice and the projection of both the electrode tip 230 and the ends of inserts 232 beyond the terminal plane of the annular nozzle body per se, resulting in an annular laminar flow nozzle path whose internal wall formed by the electrode surface does not terminate prior to the termination of the outer peripheral confining wall nozzle orifice of the annular zone, and results in the controlled relocation of the zone of intermittent arcing to a position near or outside of the terminal edge of the nozzle.

The cylindrical heat sink inserts 232 provide a greater body surface to shield the copper nozzle tip 224 which has a substantially lower melting temperature than the inserts. One refinement to the inserts 232 which helps provide longer life is to chamfer 234, 236 both ends to avoid sharp corners. This feature is of particular importance at the inner ends of the inserts because it helps reduce the sharp structural break interference type of flow path interference which creates Blasius turbulence which in turn contributes to the intermittent arcing. To a lesser extent a sharp terminal edge at the exit end of the inserts can also create Blasius type of turbulence but by projecting the inserts beyond the nozzle exit, any turbulence created by their terminal edges is at a location in the flow path of the plasma flame which is outside of the nozzle where it has essentially stabilized into relatively free laminar flow so the effect of turbulence caused by the terminal end of the insert tips is negligible.

As a result of successful operations of the new plasma torches, several desired parameters have been found. Referring again to FIGS. 8 and 9, the diameter "D" of the nozzle inner periphery at the nozzle outlet 238 should preferably be from 10 to 30 mm; the inserts 232 should use that nozzle diameter or a minutely larger diameter as a common mounting circle for their center axes in order to provide a cylindrical keyway 240 slightly greater than 180° for an embracing keyed interfit between insert and the keyway groove 240 into which they are pressed; the keyway interfit "*c*" can be up to 10 mm in length; the electrode end 230 projects a distance "*a*" of 2–3 mm beyond the nozzle terminal edge; the inserts 232 project a distance "*b*" of 10–15 mm; the distance "*e*" between electrode end 230 and inserts 232 is from 2–7 mm; and the circumferential spacing between inserts may be from "0" to 2 mm. Of course a zero circumferential spacing between inserts is technically impossible when a keyed groove insert mounting arrangement is used but when other insert mounting techniques are used the inserts can be placed to touch each other.

Solid electrode diameters *d* of 10–12 mm have been found satisfactory for high power (up to 2000 Amperes) operation. Above 2000 Amperes, multiple strand or composite electrodes up to 25 mm in diameter are satisfactory. For low power (up to 1000 Amperes) solid electrodes of 8 mm diameter are satisfactory.

The Table of Various Metals, Alloys and Metal Oxides in FIG. 20 of the drawings shows the Heat Conductivity Coefficient and the melting temperatures for the metals. Similar values can be found for other metals, alloys and metal oxides. While various materials have been tried for heat sink insert materials, tungsten and Rhenium are presently found to be the best because of their excellent coefficient of heat conductivity and its high melting temperature. The insert material should be electrically conductive and preferably should have a coefficient of heat conductivity of 0.3 and a melting temperature above 2500°C.

BLANK FEED AND OSCILLATING MECHANISM

Figure 11:
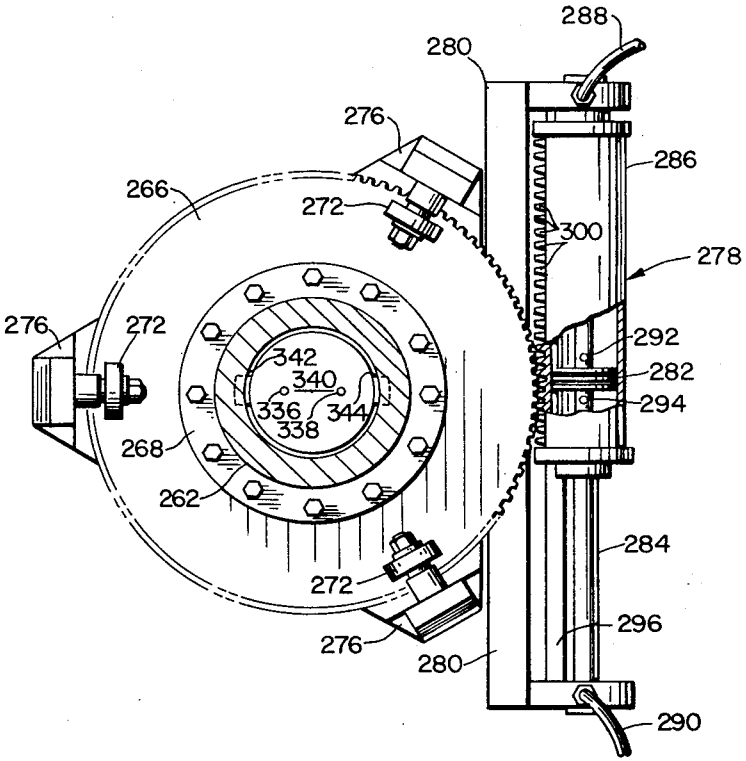
FIG. 11 is a section view taken on line 11—11 of FIG. 10 showing details of the blank oscillating structure and operator mounted in the upper end bell housing.
Figure 10:
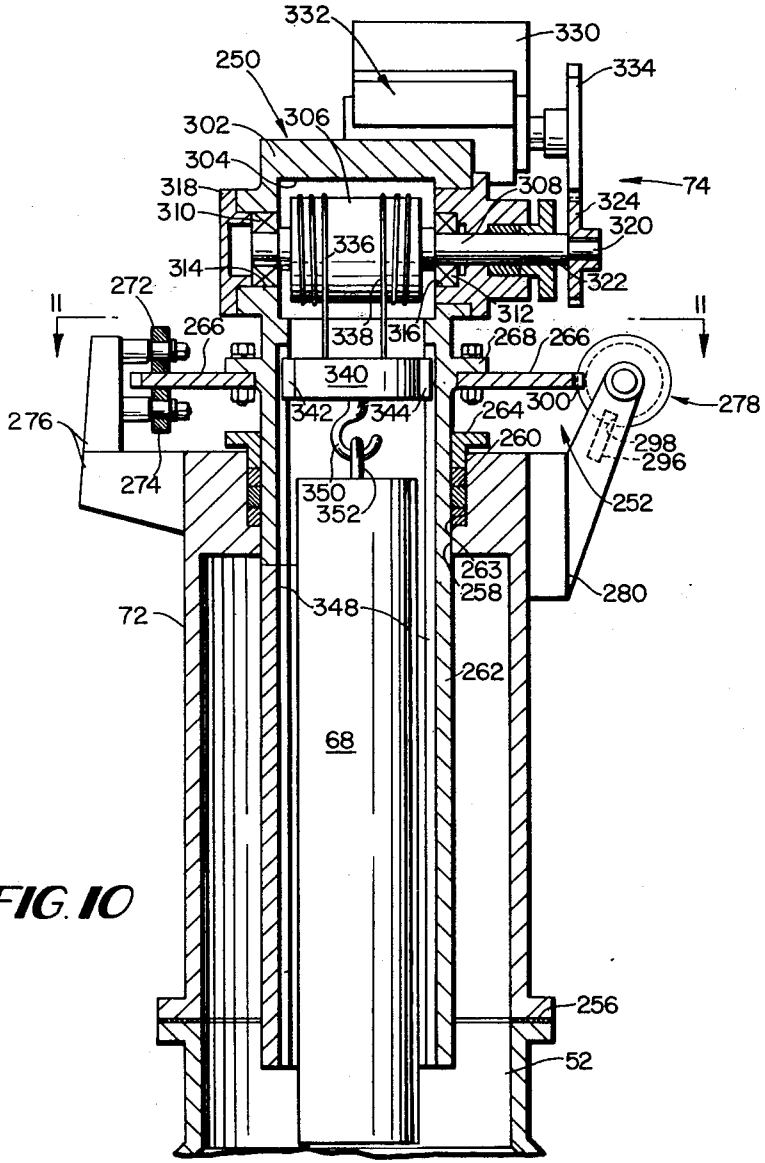
FIG. 10 is a vertical section of the upper end support bell end operating mechanism for enabling introduction, feed and oscillation of the blank.

This portion of the description will have general reference to FIGS. 1 and 4 and specific reference to FIGS. 10 and 11. As briefly described hereinbefore, the PAR furnace is arranged to accommodate top feeding of a blank 68 downwardly along the vertical axis of the furnace remelting chamber 52 as shown in FIG. 2, and feeding of the blank is accomplished by a blank feed and oscillating mechanism 74 mounted coaxially on top of chamber 52. Mounting for mechanism 74 includes a furnace bell housing 72 which can be constructed for direct installation over a flanged central opening in the remelting chamber, as shown in FIG. 1, or as an upwardly directed sleeve extension fastened on the upper end of a sleeve-like bell housing extension 69 such as shown in FIG. 2.

Bell housing 72 constitutes a rigid heavy support structure for the blank feed and oscillating assembly 74 which includes blank feeding mechanism 250 as well as blank oscillating mechanism 252. Housing 72 is a vertical sleeve-like member having lower end flanges 254 which enable the bell housing to be secured as by bolts to a mating flange on the top of the melting chamber or to the upper end of a chamber top extension. A suitable heat and vacuum seal 256 may be placed between the flanged connection. The upper end of housing 72 has a reduced diameter opening and incorporates a radial bearing 258 with a heat and vacuum seal arrangement 260 for a hollow rotatable support shell 262 which projects coaxially down through the bell housing 72. The upper end opening of housing 72 is recessed at 263 to receive the seals 260 which are secured by a gland ring 264. The gland ring can be threaded or otherwise adjustably secured to press the seals tight between the recess walls and the support shell 262. The inner periphery of the gland ring and the bearing 258 below the seal recess 263 provide a radial bearing and guide to maintain the support shell 262 coaxial within the bell housing 72.

Support shell 262 carries the entire blank feed mechanism 250, is rotatably mounted in the upper bearing end of the bell housing, and also carries a massive large diameter spur gear 266 which serves the dual purpose of transferring oscillatory drive power to the shell and of locating and maintaining the shell 262 in fixed axial disposition on the bell housing. Spur gear 266 is bolted to an outer annular flange 268 on the shell 262 adjacent but spaced down below the top end of the hollow support shell. In turn the spur gear 266 is axially fixed in a rotatable fashion between three sets of upper and lower support rollers, 272 and 274 respectively, arranged in equiangular spacing on associated double bearing support assemblies 276, the brackets of which are secured as by welding to the outside of the upper end of the bell housing 72.

Oscillatory rotational movement of the support shell is accomplished by means of a double acting hydraulic motor 278 mounted via its support bracket 280 on one side of the upper end of the bell housing 72. The exemplary hydraulic power unit has a fixed piston 282 intermediate the ends of a piston rod 284 secured at each end to an ear of bracket 280. The motor cylinder 286, is mounted on the rod 284 and surrounds the piston 282 for reciprocation between the support bracket ears. Hydraulic fluid under pressure from a suitable source (not shown) and through a suitable automatically reversing control system (not shown) is supplied through one or the other of lines 288 and 290 which connect through suitable drilled passages in the fixed piston rod to respective internal orifices 292 and 294 on opposite sides of the piston. As in well-known double acting hydraulic motors when pressure is applied in line 288, line 290 is automatically connected through valving to a drain or return conduit back to the source and vice versa. Automatic control of hydraulic system valving can be accomplished in any known manner, e.g., by electric motor driven rotary valving (not shown).

The reciprocable cylinder 286 is prevented from rotary movement by a suitable tracking device, e.g., a bar 296 fixed between the ears of bracket 280. The bar 296 can slidably fit into notches 298 (see FIG. 10) in the cylinder end plates. Rigidly fastened to or integrally formed on the outer surface and extending between the ends of cylinder 286 and parallel to its axis is a rack of gear teeth 300 which mesh with the teeth of spur gear 266. Reciprocation of the hydraulic cylinder 286 thus causes oscillation of the spur gear 266 which in turn oscillates the blank support shell 262.

The top end of blank support shell has an end wall 302 and is internally contoured by suitable means such as casting or machining into a cable drum chamber 304, receiving a cable drum 306 fixed to a support axle 308. The ends of axle 308 are journalled in heavy radial bearings 310 and 312 received in bearing recesses 314 and 316, resepectively, machined in diametrally opposed walls of the drum chamber 304. The bearings and drum are maintained against axial shift by a bearing end cap 318. One end 320 of the axle 308 projects to the exterior of the chamber through a heat and vacuum seal arrangement 322 and carries a spur gear 324 which is suitably drive connected to the axle as by a key and keyway or via a splined fitting.

Mounted on top of the upper end of the blank support shell 262 is a reversible electric motor 330 (or a suitable alternate kind of reversible rotary motor) which connects through a reduction gear box 332 to an output spur gear 334 meshed with the drum drive gear 324.

Dual wrought steel cables 336 and 338 are wound around and have one of their respective ends secured to the cable drum 306. The other ends of both cables depend in equally spaced apart diametral arrangement relative to the axis of the blank support shell and are secured in such diametral spacing to a vertically movable cross-head 340. Cross-head 340 has diametral projecting guide ribs 342 and 344 which slidably ride in internal, vertical groove tracks 346 and 348 extending from adjacent the top of shell 262 to its bottom end. Firmly secured to and depending from the underside of cross-head 340 in the exemplary disclosure is a heavy hook 350 from which is hung a blank 68 by means of eye 352 rigidly secured in the blank and projected from the center of the blank end face. Because the cross-head is keyed to the blank support sleeve and because the cross-head hook 350 and blank eye 352 are rigidly secured to the cross-head and blank respectively, oscillatory rotation of the blank support sleeve 262 will cause oscillatory rotation of the blank 68.

Furthermore, the blank feed mechanism 250 being wholly supported on the top of the blank support sleeve will be rotated with the sleeve so there is no interference between oscillatory movement and the gearing of the blank feed mechanism, each can be selectively operated independently of the other, oscillation does not effect feed movement and feed movement does not effect oscillation.

The reversible electric motor 330 will of course be operated from a suitable power source (not shown) and via suitable controls which can be manual or automatic to gradually lower the blank 68 into the furnace chamber 52 as the lower end of the blank is melting off during the plasma arc remelting process.

The construction of the feeding and blank-revolving mechanisms, are relatively simple and negate manufacture and servicing problems.

From past experience in operation of plasma-arc furnaces, it is known that a radial arrangement of plasmatrons around the crystallizer provides better operation through control of the heating of the bath because the peripheral distances between the plasmatrons can be changed. Thus one can obtain in the same furnace (by changing only the crystallizer and priming) round, square, rectangular and other spaced ingots from the same blank, for instance, of round cross section. Blanks need not be round, they can be of round or square cross section, or they can be composed of end and side scrap of sheet. In any event the novel nozzle construction, the improved controls for torch manipulation and positioning, and the simple rugged blank feed and turning mechanism, as has been hereinbefore described, results in more satisfactory operation as well as enabling operations not previously possible. The new nozzle tip construction may be utilized on existing torch bodies and will enable longer continuous operation at higher powers and will provide longer and hotter plasma flames. The torch positioning control (FIG. 4) permits accurate torch manipulation and adjustment even during remelting. At higher powers the blank is remelting at a faster rate so reliable blank feeding is absolutely necessary in order to keep the blank down in position between the plurality of radially disposed torches in the furnace cover.

ROUND AND SQUARE MOLDS

Figures 14, 15, 16, 17, 18, 19:
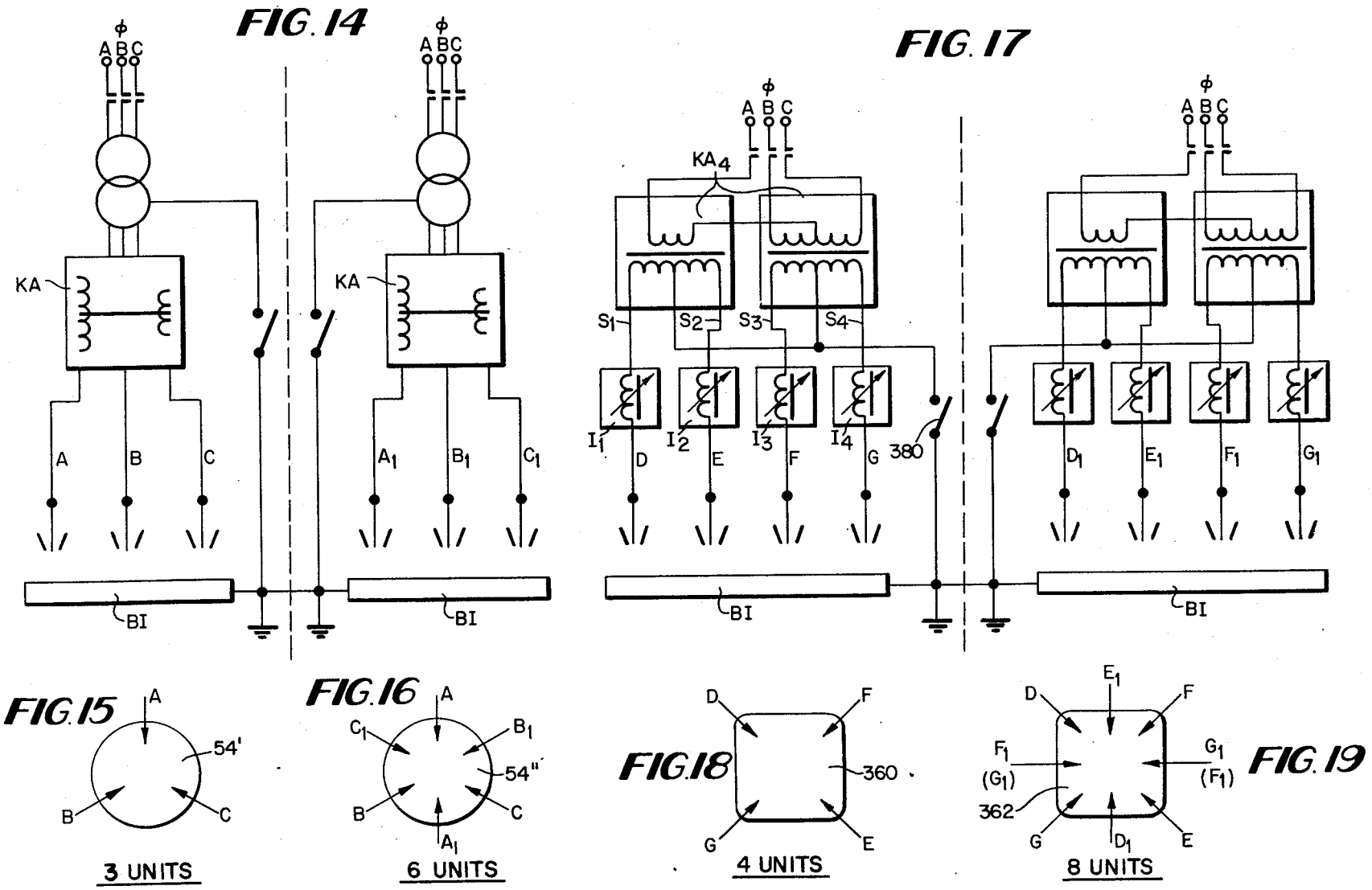
FIG. 14 is a another schematic circuit illustrating an AC circuit which can be used to power plural torches in multiples of three.
FIGS. 15 and 16 are diagrams, respectively of three and six torch plasma arc remelting installations with the electric connections to each torch labelled to correlate with the torch connections shown in FIG. 14.
FIG. 17 is another schematic circuit illustrating an AC circuit enabling powering for plural torches in multiples of four, particularly useful in remelting metal into molds of square or other polygonal cross-section.
FIGS. 18 and 19 are diagrams, respectively of four and eight torch plasma arc remelting installations with square cross section molds and with the electric connections to each torch labelled to correlate with the torch connections shown in FIG. 17.

Ingots made in a round mold 54, 54′ and 54″, such as shown in FIGS. 3, 15 and 16 should use at least two torches, but can very conveniently be made by using a crystallizer with one or more torches of any number (furnaces with at least up to eight torches are feasible and the number very probably could be higher) and the torches such as A, B and C in FIG. 15 will be equally spaced around the axis of the furnace. As shown in FIGS. 1 and 2, the blank 14 or 68 hangs down, along the furnace axis, so its lower end portion is positioned between and is radiation screening each of the torches from the plasma flames of the other torches. In circular molds, the plural plasma jets, in cooperation with radiation screening by the blank, provide a good distribution of heat over the top of the molten metal bath so its melted face takes on a flat or only a very slightly concave form and even heat disposition is easily maintained around the cooled mold wall perimeter.

The torches A, B and C in FIG. 15 are radially disposed, in plan view. FIG. 3, shows torches 58 equally spaced around a circular mold but having an angular disposition in plan view to cause a rotation of the molten metal bath. Blank oscillation when three torches are used should be at least in a 60°, back and forth rotation to result in even melting off of the blank tip. When more torches are used, as by adding torches $A_1$, $B_1$ and $C_1$ to the three torches A, B and C of FIG. 15, the six torch pattern of FIG. 16 is obtained. Again, such torches can be radial or inclined to obtain the desired plasma flame paths but with an increased number of torches, a shorter arc of blank oscillation can be used, e.g. a 30° arc, to obtain even melting off of the blank tip.

When a square or cornered molds, such as molds 360 and 362 shown in FIGS. 18 and 19, are used, it is found to be of importance to provide at least a torch for each corner. Thus, for rectangular (including square) molds at least four torches D, E, F and G are required. The corner mounting and plasma flame direction against the blank tip intentionally results in maximum radiation of heat back into the corner areas of the molten metal bath, areas which require more heat to maintain a proper molten bath thickness because the cooled mold corner structures have disproportonate cooling of the volume of metal adjacent the mold corner wall surfaces in relation to the volume of metal adjacent the flat intermediate wall surfaces.

In polygonal cross-section molds, the torches will be increased in multiples of the number of corners of the mold, e.g., the square molds 360 (FIG. 18) and 362 (FIG. 19) respectively have four torches D, E, F, G or eight torches D, E, F, G and $D_1$, $E_1$, $F_1$, $G_1$. In such installations the torches are equally spaced apart. However it is understood that with irregular shaped molds the torch positioning must of course be varied to provide the best possible disposition of the heat radiation correlated with the mold cooling wall shapes.

POWER CIRCUITS

Power for the furnaces can be either AC or DC and several exemplary circuits which can be used have been shown. The power circuits are essentially well known and will only be briefly described.

Figure 12:
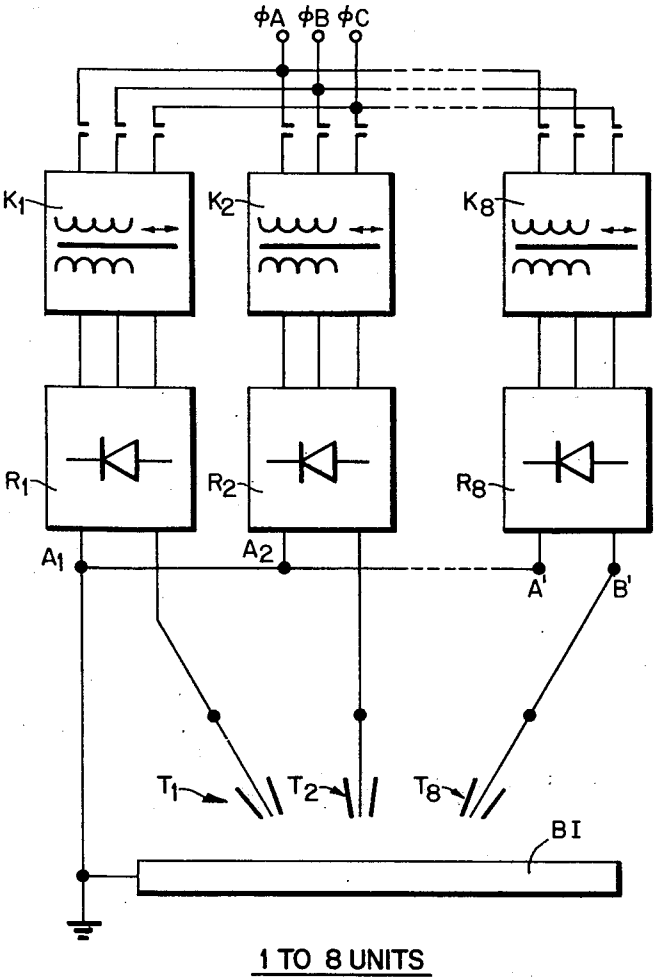
FIG. 12 is a schematic circuit illustrating one way of obtaining and connecting DC power to one or more plasmatrons.

FIG. 12 is a simple circuit using DC for the torches $T_1$, $T_2$, and $T_8$. The circuit derives AC power from a 3 phase input and the 3 phase lines connect in parallel to three phase transformers $K_1$, $K_2$, $K_8$. One or up to eight individual transformers can be provided depending on the number of torches used. The output of each transformer K connects to a rectifier bank $R_1$, $R_2$ or $R_8$. The positive output terminal A of all rectifier banks is connected to the furnace mold, ingot and hence the molten bath indicated as BI and the negative terminal of each rectifier R is connected to the electrode of an associated torch T. Equalized power can be obtained by suitable controls such as providing variable transformers $K_1$, $K_2$ . . . , $K_8$.

Figure 13:
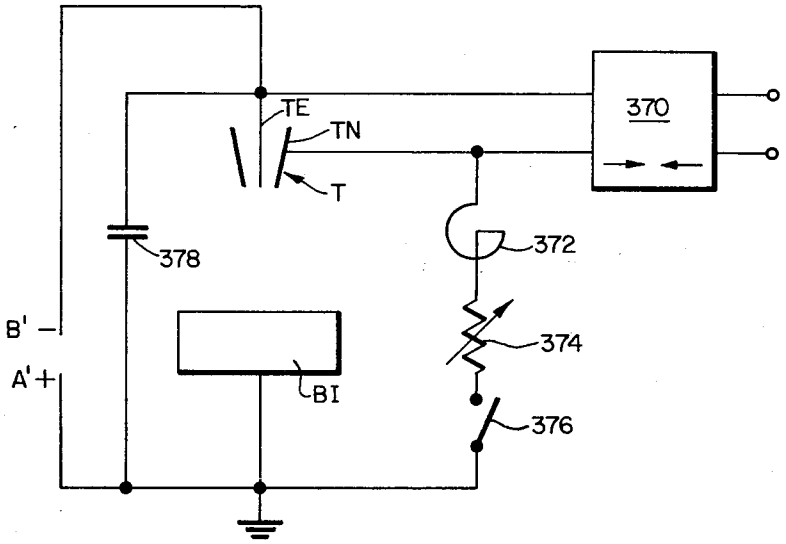
FIG. 13 is a schematic circuit illustrating a starter or ignition circuit by which a plasma arc torch can be started.

Excitation of a torch can be accomplished through circuits also known previous to this invention, one such suitable circuit being depicted in FIG. 13, where the starting arc is struck between the torch electrode TE and nozzle body TN. The circuit is energized by oscillator 370, and a parallel circuit consisting of a high frequency induction coil 372 variable resistor 374, switch 376 and condensor 378. The common ground is also connected to one side of the main power circuit and the mold, ingot bath arrangement BI.

The in-turn excitation of plural plasmatrons can be accomplished by using a common oscillator and suitable plural switching.

AC power circuits are shown in FIGS. 14 and 17. FIG. 14 illustrates a circuit suitable for three torches or for multiples of three torches and used three phase inputs to the primary windings of a three phase transformer KA for each set up three torches, A, B, C, the respective electrodes of which are connected to individual phase windings of the transformer secondarys.

FIG. 17 shows an AC circuit suitable for torches arranged in groups of four. The right hand circuit is a duplicate of the left hand circuit and enables powering of eight torches. Transformer $KA_4$ is a special wound transformer having a three phase primary winding connectd to a 3 phase power source. Using suitable ratios of secondary windings $S_1$, $S_2$, $S_3$ and $S_4$ to the associated primary windings of transformer $KA_4$ four different secondary outputs of equal current valves can be obtained and all four outputs will be out of phase with each other. Each output $S_1$, $S_2$, $S_3$ and $S_4$ is connected through a respective variable inductance $I_1$, $I_2$, $I_3$ and $I_4$ to the electrode of its respective torch D, E, F and G, and the common lead from the secondary connects to a common ground with the mold, ingot bath unit BI.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of preventing operational destruction of a plasma arc torch for use in making ingots by plasma arc remelting wherein the plasma arc torch has a center electrode, a hollow water-cooled elongate torch body and a nozzle end structure which is fastened to the end of the torch body and has a hollow water-cooled nozzle body surrounding and spaced from the lower end of the electrode to form an annular nozzle channel, comprising: substantial elimination of ablation of nozzle structure and burnthrough of nozzle structure by providing a plurality of electrically conductive heat sink material means mounted in the interior of the nozzle body, around and radially spaced from the electrode, and disposing each heat sink material means so that it provides heat sink material extending axially along the outer wall of the nozzle channel and disposed closer to the electrode than any surface portion of the nozzle body in the vicinity of the nozzle channel, to thereby control and direct the current path of intermittent arcing which occurs from electrode to nozzle structure during remelting to area and zones of the nozzle structure whereat ablation of material is minimized and burnthrough of nozzle walls does not occur.

2. A method of preventing operational destruction of a plasma arc torch as defined in claim 1 comprising: the step of assuring that intermittent arcing at the exit of the nozzle channel does not engage the nozzle body by disposing the electrically conductive heat sink material means with portions radially adjacent the electrode lower end and axially disposed beyond the terminal end of the electrode so that intermittent arcing at the exit of the nozzle channel impinges directly on the heat sink material rather than the nozzle wall.

3. A method as defined in claim 1, wherein the gas flow in the nozzle area is maintained substantially laminar.

4. A method as defined in claim 3 wherein the intermittent arcing is substantially confined to a zone beyond the terminal end plane of the primary nozzle body material.

5. A method as defined in claim 4, wherein the intermittent arcing is directed to electrically conductive material having a good heat conductivity coefficient and a melting temperature substantially higher than the primary nozzle body material.

6. A method as defined in claim 2, wherein the heat sink material is tungsten and portions of the tungsten are extended beyond the terminal edge plane of the nozzle body.

7. A method as defined in claim 6, further comprising eliminating water cooling of the nozzle body in the zone immediately adjacent the heat sink material.

8. A method as defined in claim 6, wherein plasma gas flow in the nozzle area is maintained substantially laminar.

9. A method as defined in claim 8 wherein the electrode and heat sink material project from the nozzle and the intermittent arcing is substantially confined to a zone adjacent but outside of the end of the nozzle body.

* * * * *

UNITED STATES PATENT OFFICE

CERTIFICATE OF CORRECTION

Patent No. 3,980,802 Dated September 14, 1976

Inventor(s) Boris Evgenievich Paton et al

It is certified that error appears in the above-identified patent and that said Letters Patent are hereby corrected as shown below:

Column 2, line 24, change "falt" to --flat--.

Column 3, line 10, change "tunsten" to --tungsten--.

Column 4, line 56, change "the" (second occurrence) to --this--.

Column 5, line 24, after "method" add --of--.

Column 8, line 34, change "plastrons" to --plasmatrons--.

Column 9, line 3, add --a-- after "in".

Column 9, line 13, change "amounnt" to --amount--.

Column 12, line 33, change "area" to --areas--.

Column 13, line 2, change "aspects" to --aspect--.

Column 16, line 25, change "spaced" to --shaped--.

Column 16, line 66, after "shows" add --three--.

Column 17, line 12, delete "a" after "when".

Column 17, line 22, change "disproportonate" to -- disproportionate --.

Column 18, line 3, change "used" to --uses--.

Column 18, line 5, change "up" to --of--.

Signed and Sealed this

Fourth Day of January 1977

[SEAL]

*Attest:*

RUTH C. MASON
*Attesting Officer*

C. MARSHALL DANN
*Commissioner of Patents and Trademarks*